United States Patent [19]

Brown

[11] Patent Number: 4,692,961

[45] Date of Patent: Sep. 15, 1987

[54] REMOVABLE WATER GUARD FOR SLIDING PATIO DOORS

[76] Inventor: Jerry W. Brown, 2911 N. Fairway Dr., Burlington, N.C. 27215

[21] Appl. No.: 909,690

[22] Filed: Sep. 22, 1986

[51] Int. Cl.[4] ..... E06B 3/32; E06B 7/26

[52] U.S. Cl. ..... 16/95 R; 4/609; 16/96 R; 49/476

[58] Field of Search ..... 16/90, 91, 94 R, 94 D, 16/95 R, 95 N, 95 D, 95 DW, 96 R, 96 D, 96 L; 4/557, 607, 609; 49/476; 160/44

[56] References Cited

U.S. PATENT DOCUMENTS

| | | | |
|---|---|---|---|
| 1,944,440 | 1/1934 | Lehman | 4/607 X |
| 2,889,587 | 6/1959 | Peterson | 16/96 R |
| 3,449,770 | 6/1969 | Casebolt | 4/607 |

FOREIGN PATENT DOCUMENTS

| | | | |
|---|---|---|---|
| 2262949 | 3/1975 | France | 4/557 |

*Primary Examiner*—Fred Silverberg

*Attorney, Agent, or Firm*—Charles R. Rhodes; Judith E. Garmon

[57] ABSTRACT

A water guard for removably installing along the floor track of sliding patio-type doors includes a panel member depending vertically upwardly from the door track a distance of approximately three inches. The panel member is attached to the indoor side of the sliding door track and is supported thereon by way of a resilient, inverted U-shaped clamping mechanism. The water guard is selectively installed in the door track during periods of inclement weather conditions to prevent flow of water underneath the door and into the room.

6 Claims, 4 Drawing Figures

REMOVABLE WATER GUARD FOR SLIDING PATIO DOORS

BACKGROUND AND SUMMARY OF THE PRESENT INVENTION

Sliding glass doors, or as they are commonly called "patio doors", are used in a variety of installations opening from the interior of a residence or other room environment to a patio, balcony, or other exterior area. A problem that has long existed with these doors when they are installed in connection with balconies, decks, or patios which are on a plane which is substantially level with the door track and/or interior room floor is the underflow of water from the exterior to the interior. In very bad weather conditions when there are high winds and rain, the underflow problem is increased.

As a result of the increased construction of high rise condominiums, cooperatives, and hotels along ocean shore lines, there has been a commensurate increase in use of these sliding glass doors leading from the interior of the apartment or dwelling area to an exterior balcony or deck. Because of the weather conditions existing along coastal areas where inland areas are subject to high winds and rains, particularly during hurricane seasons, it has been the experience of many that water collects on the balcony or deck and frequently rises several inches above the plane of the room flooring and door track. As this water collects and rises above the threshold or door track, water seeps in under the door and into the room. Where the room is carpeted, a wicking action frequently occurs and the carpet can be soaked for a distance of several feet into the room. Where the floors are hardwood, the water can collect and cause considerable damage to the floor and/or carpeting.

In many such environments, the dwelling is used as a vacation residence and there is not an occupant continually living in the dwelling. In such environments, when water damage occurs, it may be days or weeks before the damage is discovered and can be remedied.

Previous attempts to weatherstrip or weatherproof sliding or other types of patio-type doors have failed in most instances. The most current approach to alleviating the problem of water seepage is to increase the height of the walls of the track in which the door panels slide to a height of two or three inches. While this increased height of the track does eliminate some of the underflow problem, it creates another problem in that to step from the room environment to the exterior environment, one must step over the heightened track or threshold. This is an undesirable feature of such door installations. People frequently trip on the heightened track, creating an increased liability for injury on the part of owners or occupants due to increased likelihood of accidents.

Where attempts have been made to increase permanent weather stripping around the door by addition of rubber strips or other such mechanical devices, such stripping frequently interferes with the smooth operation of the sliding door, in addition to wearing away and decreasing in effectiveness over a period of time.

The present invention is a removable water guard for selective installation along the lower edge of such doors. The guard is comprised of a vertical panel of metal or plastic material approximately two to four inches high and cut to a length to fit across the width of the door on which it will be installed. The lower edge of the vertical panel is attached to an inverted, U-shaped channel of resilient plastic or rubber material for clamping over the inside or room interior wall of the track in which the door panels slide. A plurality of individual small clips are slidably mounted across the top edge of the vertical water guard for clipping the edge of the guard to the sidewall extremities of the door frame to hold the panel securely in an upright position.

When bad weather conditions occur, or at any time the occupant is going to be away from the residence for an extended period of time, the water guard is merely clipped onto the door track, with both door panels closed, and left in position until the owner/occupant returns and requires free use of the door. The water guard protects against the underflow of water which gathers on the associated exterior balcony or deck and substantially eliminates any flow of water or moisture under the door. The water guard is easily installed or removed and when not in use can be conveniently stored in a nearby closet or like storage area.

In a preferred embodiment, the vertical panel of the water guard is made of a rigid but slightly flexible polymeric material and may be either transparent or opaque. Additionally, of course, it is obvious that the water guard could be made of a metal material such as extruded aluminum.

A better understanding of the objectives and structure of the present invention will be apparent to those skilled in the art as the following detailed description is studied in conjunction with the accompanying drawings.

IN THE DRAWINGS

DETAILED DESCRIPTION OF A PREFERRED EMBODIMENT

Figure 1:
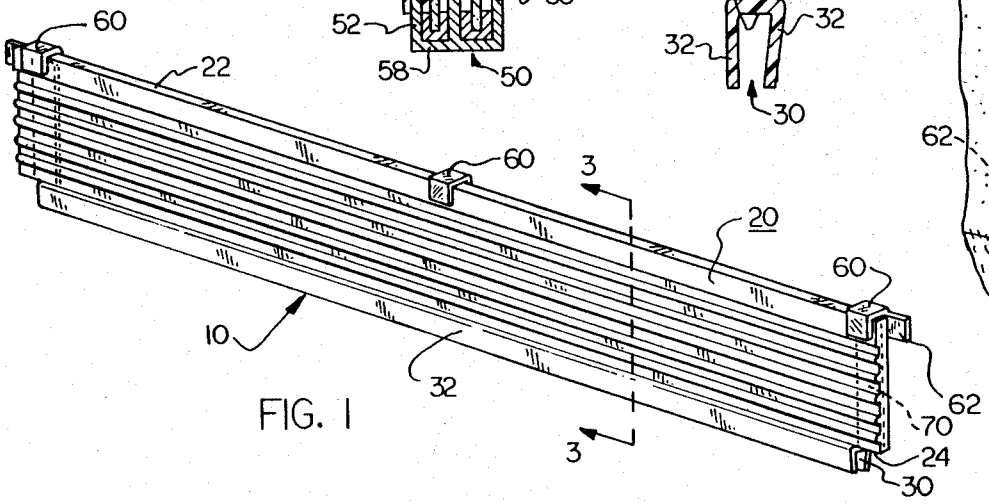
FIG. 1 is a perspective view of the of the water guard according to a preferred embodiment.

In the preferred embodiment shown in FIG. 1, the water guard 10 is generally comprised of a transparent piece of extruded or otherwise molded polymeric material which is formed into a vertically extending upright panel 20. As stated above, the guard portion may be transparent or opaque. It preferably of polymeric material but could also be made from a variety of metallic materials. The panel portion 20 includes an upper edge 22 and a lower edge 24. Along the length of the lower edge 24 there is permanently attached, or integrally molded, a U-shaped inverted channel 30.

Figure 3:
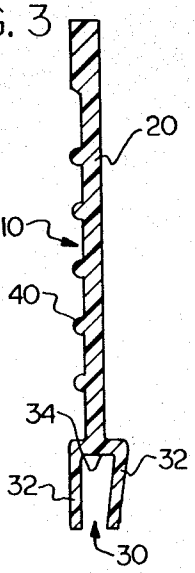
FIG. 3 is a cross-section taken along lines 3—3 of FIG. 1.
Figure 4:
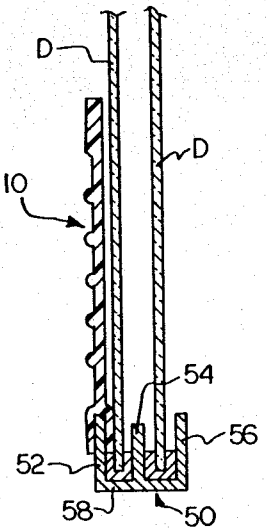
FIG. 4 is a cross-section taken along lines 4—4 of FIG. 2.

This inverted channel 30 is preferably formed of rubber, synthetic rubber or other polymeric material of a semi-rigid but flexible nature. As best seen in cross-section in FIG. 3, the inverted channel 30 includes opposing sidewalls 32 and an upper wall 34. The sidewalls 32 are slanted inwardly toward each other along the downward, open side of the channel. This inward slant allows for a tighter gripping action on the door track when the guard 10 is installed on the patio door D. The resilience of the polymeric material which is used to form channel 30 allows the sidewalls 32 to expand apart for insertion over one wall 52 of the door track 50 as best shown in FIG. 4. When in place, the resilient memory of walls 32 provides for a friction gripping action against the wall 52 of the door track. Such door tracks 50 generally include an upwardly extending interior wall 52, central wall 54, exterior wall 56 and bottom wall 58. Interior and exterior being with reference to the room environment.

Longitudinally extending ribs 40 are molded along the outside face of the length of the vertical panel 20 for support and strengthening. There are clips 60 shown across the upper edge 22 of the vertical panel and are slidable along upper edge 22 for engagement behind the vertical frame of the outside edges of the door (See FIG. 2). The clips are comprised of an inverted U-shaped piece of rigid polymeric material which clip over the upper edge of the panel 20 and include an extension 62 (FIG. 1) that is engaged between the end of the vertical guard 20 and the edge of the patio door frame to prevent the guard from tilting forward away from the door.

Figure 2:
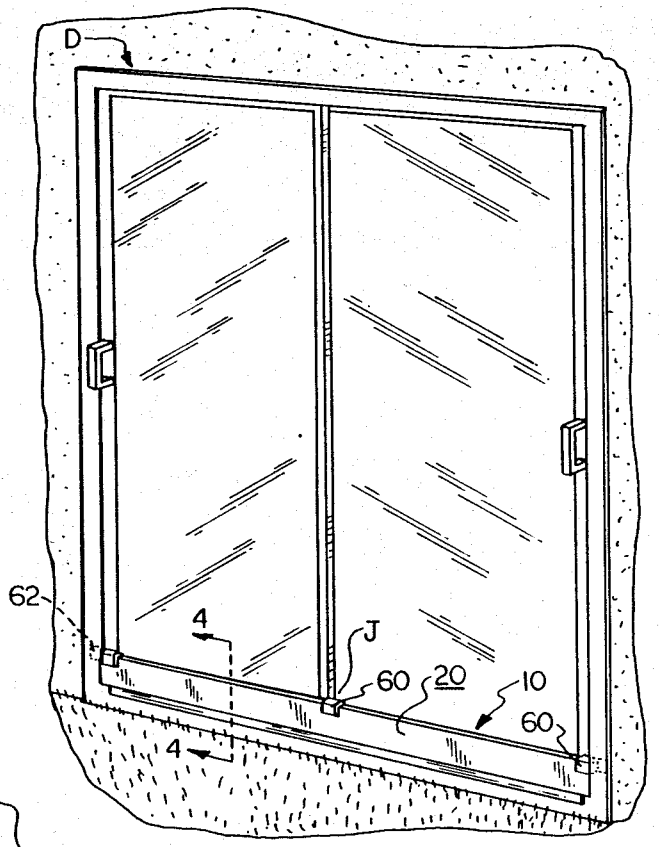
FIG. 2 is a perspective view of the water guard as it is installed over the patio doors.

Referring to FIGS. 2 and 4, in use, the guard 10 is placed on the room side of the closed sliding doors. The U-shaped channel 30 is mounted over the room side vertical wall 52 of the track 50 in which the door slides (FIG. 4). The resilience of the water guard allows some compensation by flexing at the junction J of the overlapped edges of the closed doors. The clips 60 are then slipped into place on either end of the guard, between the guard and the door, slipped between the door and the door frame, to hold the guard upright. Thus installed, the flow of water underneath the doors is substantially prevented.

Additionally provided are selectively attachable narrow strips of rubberized weather stripping 70 which may, if desired, be adhesively attached to the rear face of the panel 20 (FIGS. 1 and 4). The strips 70 are approximately one-half inch wide and extend vertically along the height of each end of panel 20. One side of the rubberized strip 70 includes a self-adhesive backing that is the means for attachment to the panel 20. When attached as shown in FIGS. 1 and 4, the strip protects against leakage between the side of the doors and the panel.

While a preferred embodiment has been described, it is apparent that further modifications might be made to the invention while remaining within the scope of the claims below.

What is claimed is:

1. A water guard for removable attachment to the floor track of a pair of sliding glass doors where the track is formed of at least two opposed sidewalls between which the doors slide, one of said track walls being in the interior room environment and the opposed said wall being in the exterior environment; said water guard including:

(a) a substantially flat, elongated panel having a prescribed height and a width approximately equivalent to that of said doors, upper and lower edges, front and rear faces, and including means for removably attaching said panel in vertical relationship to the room floor, to said interior sidewall of said door track such that said panel rear face lies closely adjacent the interior face of said doors;

(b) said means for attaching said panel to said track wall including an inverted channel attached along the lower edge of said panel; said inverted channel being substantially U-shaped such that the open side is slipped over said interior track wall for supporting said panel along the lower edge of the interior face of said doors; whereby said water guard substantially seals the lower edges of said sliding doors and prevents flow of water underneath; and further including clip means slidably mounted along said upper edge of said panel for engagement with the sidewalls of the surrounding frame of said doors to prevent said panel from tilting away from said doors.

2. A water guard according to claim 1 wherein said prescribed height is in the range of two to four inches above the upper edge of said inverted channel.

3. A water guard according to claim 1 wherein said panel is formed of a substantially rigid, but slightly resilient polymeric material.

4. A water guard according to claim 1 wherein said inverted channel is formed of a semi-rigid, but slightly flexible material for gripping the sides of said track wall.

5. A water guard according to claim 4 wherein said inverted channel further includes the sidewalls thereof being flexibly directed toward each other along the open side of said channel to improve the friction gripping action on said track wall.

6. A water guard according to claim 1 and further including a plurality of spaced apart reinforcement ribs extending horizontally along one face of said panel.

* * * * *